US007643923B2

(12) United States Patent
Buehlmann et al.

(10) Patent No.: US 7,643,923 B2
(45) Date of Patent: Jan. 5, 2010

(54) METHOD AND DEVICE FOR MONITORING A ROAD PROCESSING MACHINE

(75) Inventors: Andreas Buehlmann, Oberhofen am Thunersee (CH); Peter A. Stegmaier, Uetikon a/S (CH); Volker Kuch, Dreieich (DE)

(73) Assignee: Leica Geosystems AG, Heerbrugg (CH)

( * ) Notice: Subject to any disclaimer, the term of this patent is extended or adjusted under 35 U.S.C. 154(b) by 255 days.

(21) Appl. No.: 11/721,976

(22) PCT Filed: Dec. 19, 2005

(86) PCT No.: PCT/EP2005/056932

§ 371 (c)(1),
(2), (4) Date: Jun. 16, 2007

(87) PCT Pub. No.: WO2006/064062

PCT Pub. Date: Jun. 22, 2006

(65) Prior Publication Data

US 2008/0208417 A1 Aug. 28, 2008

(30) Foreign Application Priority Data

Dec. 17, 2004 (EP) ..... 04029963

(51) Int. Cl.
*G06F 7/70* (2006.01)

(52) U.S. Cl. ..... 701/50; 172/4.5

(58) Field of Classification Search ..... 172/4.5, 172/811; 701/50; 356/5.08, 139
See application file for complete search history.

(56) References Cited

U.S. PATENT DOCUMENTS

| | | | | | |
|---|---|---|---|---|---|
| 4,807,131 | A | | 2/1989 | Clegg | |
| 4,895,440 | A | * | 1/1990 | Cain et al. | 356/5.08 |
| 5,174,385 | A | * | 12/1992 | Shinbo et al. | 172/4.5 |
| 5,375,663 | A | * | 12/1994 | Teach | 172/4.5 |
| 5,549,412 | A | | 8/1996 | Malone | |
| 5,612,864 | A | * | 3/1997 | Henderson | 700/59 |
| 5,764,511 | A | * | 6/1998 | Henderson | 700/66 |
| 5,964,298 | A | | 10/1999 | Greenspun et al. | |
| 6,421,627 | B1 | | 7/2002 | Ericsson | |

FOREIGN PATENT DOCUMENTS

| | | |
|---|---|---|
| DE | 199 51 297 | 4/2001 |
| DE | 100 25 474 | 12/2001 |
| DE | 100 06 903 | 7/2002 |
| EP | 1 079 029 | 2/2001 |

* cited by examiner

*Primary Examiner*—Mark Hellner
(74) *Attorney, Agent, or Firm*—Workman Nydegger

(57) ABSTRACT

The aim of the invention is to monitor the travel way of a road processing machine that drives on a basic surface as well as the working height of a working part which is disposed thereon in a vertically adjustable manner. Said aim is achieved by detecting the three-dimensional position of a positional element, determining a direction of travel from at least two three-dimensional positions, and determining the working height of the working part. The determined direction of travel is compared to a setpoint direction while the working height is compared to a setpoint height. The positional element is placed in a position that is at a horizontal distance from the working part.

20 Claims, 1 Drawing Sheet

METHOD AND DEVICE FOR MONITORING A ROAD PROCESSING MACHINE

BACKGROUND

The invention relates to a method for monitoring the travel path of a road processing machine which drives on a base surface, a road processing machine and a system for carrying out a method for monitoring the travel path of a road processing machine driving on a base surface and the working height of a working part arranged thereon in a vertically adjustable manner.

In the construction and repair of roads and squares, machines which drive along a predetermined travel path and carry out a desired processing step are used for various operations. For example, road finishers comprising a vehicle and a smoothing board or a screeding beam fixed thereon in a vertically adjustable manner are used for applying asphalt surfaces. The asphalt material is distributed from the vehicle along the front edge of the smoothing board. When the machine advances to the prepared road bed, the smoothing board scrapes over the asphalt material and smoothes and compacts it in order to provide a continuous asphalt surface having the desired surface profile.

The prior art discloses various solutions by means of which the smoothing board can be positioned vertically so that a desired surface profile is achieved as exactly as possible. For the vertical positioning, for example, a reference is used. If, for example, a rope or a wire has to be stretched as a reference line along the road to be asphalted, this entails considerable effort. If the base surface to which the asphalt is applied is used as a reference, it must be formed very exactly with great effort. According to a further solution, a laser beam is used as a reference, in which case the height of the smoothing board relative to the laser is determined using a sensor fixed to the smoothing board, and the smoothing board is kept at a desired height.

DE 100 60 903 describes a prior art in which the position of a reference surface is determined using a sensing ski or using three laser measuring heads a distance apart in the direction of movement. In order to avoid a complicated construction for holding the laser sensors, it is proposed to arrange, at a point above the smoothing board, three differently oriented laser telemeters which determine the distance to three measuring points located one behind the other in the direction of movement. The distance values are each converted into a height and a horizontal distance. Depending on the heights determined and on the required height, a height control signal for the smoothing board or another processing tool is generated.

The accuracy of the height determination using the obliquely oriented laser telemeters is reduced by the accuracy of mounting and by the fact that at least one measuring point lies on the already applied surface. In the case of road construction machines, an exactly constant sensor orientation is scarcely achievable owing to vibrations and large temperature and humidity variations. In the case of telemeters directed obliquely forwards, a small unknown change in angle is sufficient to lead to a considerable error in the height calculated from a measurement assuming the false orientation.

U.S. Pat. No. 5,549,412 discloses a method in which a road processing machine comprising a vertically adjustable working part is used together with at least one transmitter. A sensor on the machine receives at least one signal of the at least one transmitter, and height position information which is used for the vertical positioning of the vertically adjustable working part is derived from the received signal. For example, a GPS system is used as the system comprising transmitter and sensor. In order to achieve a desired surfacing over a reference surface, the reference surface is driven over without processing merely for determining the reference surface position, which is associated with a double driving effort.

EP 1 079 029 A2 discloses a solution in which a GPS system and a tilt-adjustable rotational laser system are used for the three-dimensional control or levelling of the construction machine. The GPS system on the construction machine determines two position coordinates of the construction machine, which are communicated to the stationary rotational laser system. A required height is coordinated with the actual position coordinates, and the rotational laser is oriented so that, in the case of a linear laser receiver of the construction machine, it marks the required height. The laser receiver determines the actual deviation of the working tool from the required height. The height position of the working tool is adjusted according to this deviation. This solution is very complicated because it comprises a GPS system, a complex rotational laser system, a radio link between these systems, a linear laser receiver and at least one control. In addition, problems arise in areas, for example, under bridges, where the satellite signals required by the GPS system cannot be received.

Further possibilities for height determination of the working part are described in DE 196 47 150, in which a device and a method for controlling the installation height of a road finisher are described. The determination of the height of the screeding beam edge is effected here by potentiometer sensors, ultrasonic sensors or laser receivers.

DE 199 51 297 C1 relates to an automatic longitudinal control of a road finisher during the installation of a road layer. Solutions are used in which a prism arranged on the road finisher is followed by a total laser station. This station follows the prism by means of an optical system which can be oriented in all directions. The position of the construction machine or of the screeding beam is calculated from the solid angle of the optical system, the distance between prism and optical system and the position of the total station. For the exact height regulation of the screeding beam, the prism must be arranged as directly as possible above the rear edge of the screeding beam. However, this then results in inaccuracies in steering which adversely affect the surface profile. In order to compensate the effects of the inaccuracies in steering, parts of the screeding beam which are displaceable transversely to the travel direction are proposed, so that, even in the case of an inaccurate travel path, a precise application of the surface is ensured by an optimum lateral displacement of these parts.

A road processing machine comprising laterally displaceable screeding beam parts has a complicated mechanical design. In the case of construction machines without possibilities for lateral adjustment, the problems arising from the inaccuracy in steering persist.

SUMMARY OF THE INVENTION

It is the object of the invention to find a simple solution by means of which a vertically adjustable working part of a road processing machine can be precisely positioned in the vertical direction and the steering function of the road processing machine can be improved.

In achieving the object, it was recognized that the prism on the road processing machine can be arranged a horizontal distance away from the working part, before the centre of gravity of the road processing machine, and hence the steering function can be improved, without the height regulation of the working part being adversely affected. For this purpose, however, the height determination at the prism must be converted with the use of at least one value of at least one reference determination into a height at the working part (screeding beam).

Of course, instead of a total laser station and a passive prism, it is also possible to use an active position element, for example a GPS device. An active position element should be capable of determining its position with the aid of other elements whose positions are known. The other elements in turn may be active or passive elements. If a GPS device is used as a position element, it should also be capable of determining the position in the vertical direction as accurately as possible. If required, a further signal from a vertical positioning transmitter, for example designed as a rotating laser, is fed to a position element in the form of a modified GPS device, so that the three-dimensional position of the position element can be determined very accurately in the vertical direction too from the satellite signals and the further signal.

Suitable methods and devices for positioning or height measurement with laser reception are described, for example, in U.S. Pat. No. 4,807,131.

If the position element is connected to the working part via a fixed link, an effective height difference between the position element and a point at the working part can be determined for every possible orientational position of this link. The effective height difference can be most accurately determined if the tilt of the direct connecting line between the position element and the point at the working part, i.e. an angle to the vertical or to the horizontal, is determined.

If the link consists of at least one substantially vertical and one substantially horizontal segment, it is also possible to determine the respective tilts of both segments. However, if the fixed link is rotated substantially only about a single horizontal axis, a single tilt determination is sufficient.

The horizontal pivot axis of the rod system leading to the working part is changed in height by a height adjustment device. This makes it possible for the working part to float on the warm asphalt material. In order to determine the exact position of the working part starting from the determined position of the position element, a height difference between position element and working tool must be determined using at least one value derived from a reference determination.

The reference determination preferably comprises a tilt determination, by means of which the actual orientation of the fixed link is determined. The orientation of the fixed link can optionally also be determined by means of two distance measurements to the base surface or to a reference height. For this purpose, the distances from two different points of the fixed link to a reference position are determined.

Because the road processing machine travels forwards on the base surface, two points which are arranged offset in the travel direction are staggered with respect to time over the same region of the base surface. If the horizontal distance between the two points of the fixed link is divided by the travel velocity, the time interval which is to pass between a distance measurement in the case of the first point and a distance measurement in the case of the second point is obtained. With this time interval, it is possible to ensure that the two distance measurements are made to the same reference surface. Alternatively, it is also possible to use the position determination with the aid of total station and prism.

The height difference between position element and working part can be determined from the two distances to a reference surface. In the case of a known height of the position element, the height position of the working part or of a working edge can be exactly determined using the height difference determined. This height determination of the working part can also be carried out if no fixed link is present between position element and working part. This means that, for example in the travel direction, a position element and a first distance sensor for determining a distance to the base surface are arranged on the front of the road processing machine. A second distance sensor offset in a backward direction relative to the first sensor in the travel direction is arranged on the working part. This arrangement can be used for the height determination of the working part when the machine is running in a straight line, even without a fixed link between working part and position element. In curves, the position determination can be used.

If the height-adjusting device carries out only a parallel displacement of the fixed link during the adjustment, the height difference does not depend on the adjustment height. In the case of a base surface whose orientation is substantially the same everywhere, for example horizontal, the height correction is constant and all that is necessary is to check that no further correction is necessary. Accordingly, the reference determination consists in monitoring the parallel orientation.

In the case of a base surface whose orientation changes along the travel path, the orientation of the road processing machine or of the base surface underneath can be determined by means of at least one tilt determination. The measured tilt can be used as a reference determination for correcting the height. The actual height of the working part is obtained from the position of the position element and this height correction.

Because the height position of the working part can always be accurately determined even when the position element is arranged a distance away from the working part in the longitudinal direction of the road processing machine, in particular by at least half the longitudinal extension or even the whole longitudinal extension of the machine, the position element can be arranged so that the travel path of the road processing machine can also be optimally monitored. In order to ensure the high sensitivity with regard to vehicle movements away from the travel path, the position element is fixed at a point of the road processing machine which is as far as possible from the turning axis. In particular, the positioning of the position element is chosen with regard to optimized signal utilization with respect to the determination of the travel path of the road processing machine. Thus, for example in the case of arrangement of the position element as close as possible to the front chassis of the machine, changes in the position of the machine can be determined extremely rapidly and precisely by measurements to the position element. For example, the position element can be arranged before the centre of gravity of the machine in the travel direction, laterally at the left or right edge of the machine. The positioning of the position element at the front end of the road processing machine in the travel direction, as far as possible to the left or right—and hence as far to the front as possible and close to the chassis—is particularly advantageous.

Because road processing machines having a vertically adjustable working part generally turn on travelling through a curve in such a way that the working part does not swivel out or at least swivels out only slightly, the position element should be as far away as possible from the working part. If the working part is arranged in the rear end region of the machine, the position element is arranged in the front end region. In the case of undesired lateral swivelling out of the vehicle, the position element is moved noticeably away from the line of travel. A correction control can immediately bring the road processing machine back to the desired travel path. The working part always remains substantially on the desired path.

For the generically precise monitoring of the travel path of the road processing machine, the position element is mounted at a position at least before the centre of gravity of the machine—in the travel direction of the machine—in particular as far as possible before the centre of gravity of the machine. The mounting of the position element or of the prism as far as possible to the front also permits a simpler design of the monitoring algorithm, which is simpler in that in this way the regulation of the travel direction can be based directly on the horizontal error, and the longitudinal axis of the road processing machine need not be known. Additional knowledge thereof does of course improve the regulation.

In the case of the solution according to the invention, a precise travel movement and precise height positioning of the working part can be achieved by only one position monitoring using a position element, e.g. GPS or a prism. For determining the height of the working part, all that is necessary is to carry out at least one type of reference determination.

BRIEF DESCRIPTION OF THE DRAWINGS

The drawings explain the invention with reference to two working examples.

DETAILED DESCRIPTION OF THE DRAWINGS

Figure 1:
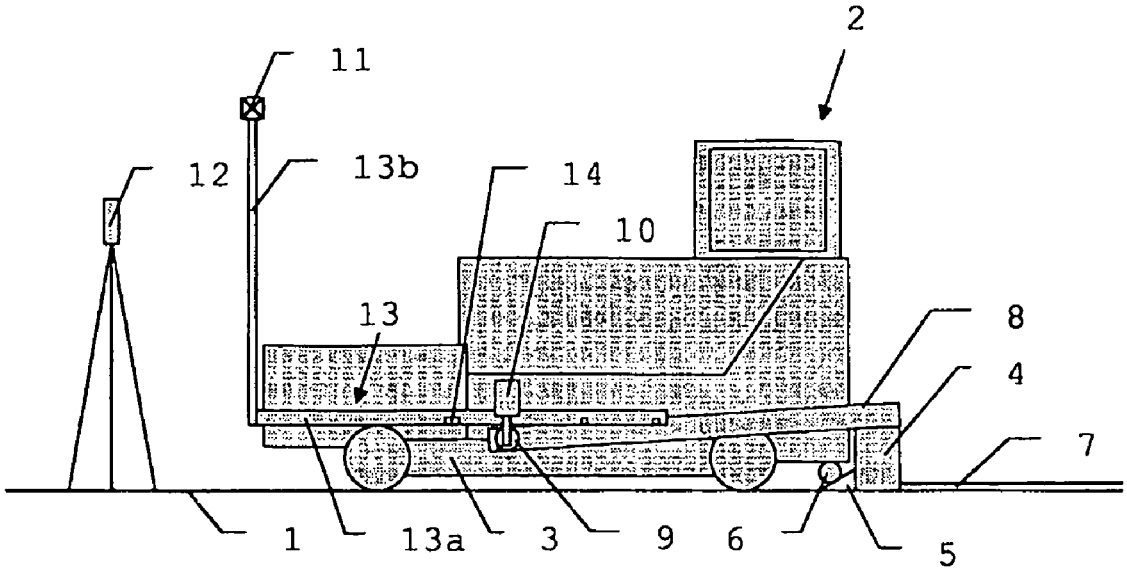
FIG. 1 shows a schematic side view of a road processing machine comprising a tilt sensor and FIG. 2 shows a schematic side view of a road processing machine comprising two distance-measuring devices
Figure 2:
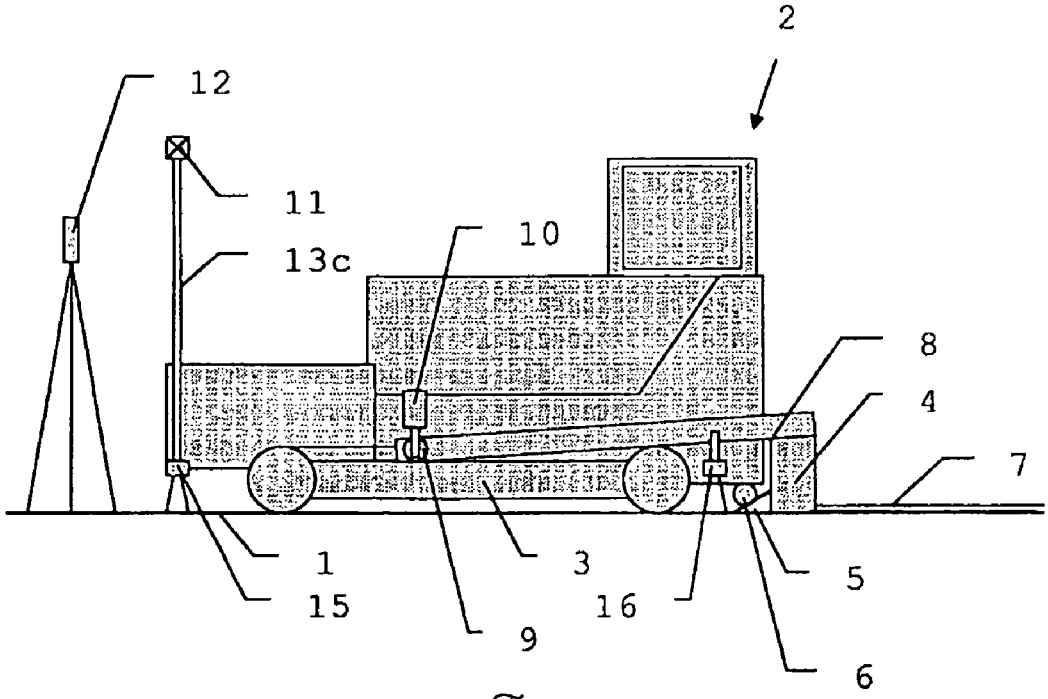

FIGS. 1 and 2 show a road processing machine 2 travelling on a base surface 1. The machine shown is a road finisher comprising a vehicle 3 and a working part 4 in the form of a screeding beam which is fixed thereon in a vertically adjustable manner. The asphalt material 5 is distributed by a distributing member 6 along the front edge of the working part 4. When the road processing machine 2 advances towards the prepared base surface 1, the working part 4 arranged at the rear end of the road processing machine 2 scrapes over the asphalt material 5 and smoothes and compacts it in order to provide a continuous asphalt surface 7 having a desired surface profile. The positioning of the working-part 4 at a desired height is effected by means of a slight pivot movement of two carriers 8 which are arranged pivotably on both sides of the machine and whose pivot bearings 9 as points of rotation can be moved by hydraulic cylinders as actuating members 10 or can be adjusted in height.

In order to simplify exact processing along a desired travel path, the respective actual position and/or travel direction should be determined at points along the travel path, the working height of the working part should be determined, and the determined position or travel direction should be compared with a required position or required direction and the working height should be compared with a required height. As soon as the position or travel direction deviates from the required position or required direction at the corresponding location, a control signal should be provided, by means of which the deviation can be compensated by appropriate control of the road processing machine 2. If the working height deviates from the required height, the working part 4 should be raised or lowered by the carriers 8 until the desired height is achieved.

A position element arranged on the road processing machine 2 can, in the case of an embodiment comprising a prism 11, be monitored by means of a total laser station 12. This station 12 follows the prism 11 by means of an optical system which can be oriented in all directions. The position of the prism 11 is calculated from the solid angle of the optical system, the distance between prism 11 and optical system and the position of the total station 12. For a comparison with a desired travel path, the positions and/or directions along the desired travel path must be present as required values for the road processing machine 2 at the point at which the prism 11 is arranged. In order to ensure a desired processing path in the case of the working part, the behaviour of the road processing machine 2 in curves should be taken into account in the determination of the required path for the prism 11 so that the working part 4 moves along the desired path. The travel direction can be determined from successive positions.

Because, in road processing machines 2, directional changes due to lateral movements of the front end of the machine are generally more pronounced than in the region of the working part, and because the regulation algorithm of the direction regulation on the basis of the position of the prism is simpler without a knowledge of the longitudinal axis of the machine, the prism 11 is positioned as far as possible to the front—in the embodiment, for example, at that extreme left end of the road processing machine 2 which is at the front in the travel direction. Here, the prism 11—at the front end—is positioned the whole longitudinal extension (extension in the travel direction) of the road processing machine 2 away from the working part 4—at the rear end—in the longitudinal direction (travel direction). This permits good monitoring of the machine with only one prism.

The permissible tolerances in the working height are smaller than in the case of the lateral orientation of the working part. For the comparison of a determined working height with a required height, the actual height of the working part 4 must be determined extremely accurately. There is no fixed relationship between the positional height of the prism 11 and the working height of the working part 4 because they are arranged offset in the longitudinal direction of the machine. If the base surface 1 is inclined in the travel direction, the working part 4 is lower relative to the height of the prism 11 than in the case of a level base surface 1. The raising and lowering movements of the carriers 8 and also variable inclinations of base surface 1 change the height difference between prism and working part 4.

In order to be able to derive a working height which is as accurate as possible from the positional height of a prism 11, at least one value of at least one reference determination should be used for calculating the working height in the case of the working part.

The total laser station 12 is connected to an evaluation and control device, which is not shown, for evaluating the position information of the position element—in this case of the prism 11—and for providing control signals for controlling the road processing machine 2 and for controlling the height adjustment of the working part 4. The at least one reference sensor for carrying out at least one reference determination is likewise connected to the control device. At least a part of the connections are in the form of radio links. The control device is preferably arranged on the road processing machine 2 but could optionally also be arranged in the total laser station 12. If the control device is arranged on the machine 2, the connections to sensors and activation devices may be in the form of cable connections.

According to FIG. 1, a first embodiment proposes forming a fixed link 13 from one of the carriers 8 to the prism 11. This link 13 comprises, for example, a substantially horizontal linking part 13*a* and a vertical linking part 13*b* connected thereto. If the prism 11 is connected to the working part 4 via a fixed link, an effective height difference between the prism 11 and a point on the working point 4 can be determined for every possible orientation position of this link 13. For determining the effective height difference, it is most accurate if the tilt of the direct connecting line between the prism and the point on the working part 4, i.e. an angle to the vertical or to the horizontal, is determined. For this purpose, a tilt sensor 14 oriented in the direction of the direct connecting line may be fixed on a part of the fixed link 13.

In the embodiment shown, the tilt sensor 14 is fixed on the horizontal linking part 13*a*. Optionally, a second tilt sensor, oriented perpendicularly to the first tilt sensor, is also arranged on the fixed link so that the tilt of the fixed link can be determined in two different directions. A tilt sensor mounted transversely to the travel direction can thus provide additional information.

According to FIG. 2, in a second embodiment, for reference determination, at least one first distance measurement to the base surface 1 is carried out at the prism 11 by means of a first distance-measuring device 15 and, at a different time, at least one second distance measurement to the base surface 1 is carried out at the working part 4 by means of a second distance-measuring device 16. The time offset between measurements belonging together should be chosen on the basis of the travel velocity so that the two measurements are effected substantially at the same reference point. There is no need for a fixed link to be present between the prism 11 and the working part 4. The prism is connected to the road processing machine 2 via a retaining rod 13*c*.

Between the prism 11 and the first distance-measuring device 15, there is a fixed distance in the vertical direction and substantially a vanishing distance in the horizontal direction. Analogously, there must be a fixed distance in the vertical direction and as small a distance as possible in the horizontal direction between the working part 4 and the second distance-measuring device 16. Because asphalt material 5 is distributed by a distributing member 6 at the working part 4, the second distance measurement must preferably be carried out directly before the distributing member 6 so that the base surface is still exposed. If the distance measurement is made to the side of the applied asphalt, it can also be carried out directly adjacent to the working part. Of course, the arrangement of the second distance-measuring device 16 can be adapted to the respective working part 4.

Of course, methods comprising at least one tilt determination and additionally at least one first distance measurement to the base surface 1 and, at a different time, at least one second distance measurement to the base surface 1 at the working part 4 can also advantageously be used.

What is claimed is:

1. Method for monitoring the travel path of a road processing machine driving on a base surface and the working height of a working part arranged thereon in a vertically adjustable manner, in which method the three-dimensional position of a position element arranged on the road processing machine is determined and the working height of the working part is determined, the method comprising:

comparing the working height with a required height, and/or comparing the determined position with a required position, and/or comparing the determined travel direction with a required direction, wherein:

the position element is arranged at a position which is located a distance away horizontally from the working part in the longitudinal direction of the road processing machine by at least half of the longitudinal extension and before the centre of gravity of the road processing machine in the travel direction, in the longitudinal direction of the road processing machine, at the end thereof which is at the front in the travel direction; and laterally on the road processing machine in the edge region thereof, and the positional height of the three-dimensional position of the position element is converted into the working height at the working part using at least one value of at least one reference determination.

2. Method according to claim 1, wherein the position element is positioned a distance away horizontally from the working part in the longitudinal direction of the road processing machine by the whole longitudinal extension, of the road processing machine.

3. Method according to claim 1, wherein:

the position element is arranged at the extreme left or extreme right front end, and the working part is arranged at the rear end of the road processing machine in the travel direction.

4. Method according to claim 1, wherein a fixed link is formed between the position element and the working part.

5. Method according to claim 4, wherein, for the reference determination, at least one tilt determination is carried out by means of a tilt sensor arranged on the fixed link.

6. Method according to claim 5, wherein, for the reference determination, two tilt determinations are carried out by two tilt sensors arranged on the fixed link and oriented differently.

7. Method according to claim 5, wherein a height difference between the positional height of the position element and the working height of the working part is derived from the at least one tilt determination.

8. Method according to claim 1, wherein, for the reference determination, at least one first distance measurement to the base surface is carried out at the position element and, at a different time, at least one second distance measurement to the base surface is carried out at the working part, the time offset being chosen on the basis of the travel velocity or of a position determination so that the two measurements are effected substantially at the same reference point.

9. Method according to claim 8, wherein the position of the reference point is derived from the positional height of the position element and the at least one first distance measurement and, while the road processing machine is traveling.

10. Method according to claim 8, wherein a working height is derived from the positional height of the position element, the at least one first distance measurement and the at least one second distance measurement, and, while the road processing machine is traveling.

11. A road processing machine comprising:

a working part arranged in a vertically adjustable manner on the road processing machine and a position element arranged on the road processing machine, the road processing machine being movable on a base surface and the three-dimensional position of the position element being capable of being determined by at least one station, and it being possible to evaluate the position information of the position element by an evaluation and control device and to provide control information for controlling the road processing machine and the height adjustment of the working part, wherein:

the position element is arranged a distance away horizontally from the working part in the longitudinal direction of the road processing machine by at least half of the longitudinal extension and before the centre of gravity of the road processing machine in the travel direction, in the longitudinal direction of the road processing machine, at the end thereof which is at the front in the travel direction and laterally on the road processing machine in the edge region thereof, and at least one reference sensor for carrying out at least one reference determination is coordinated with the road processing machine, the positional height of the three-dimensional position of the position element being convertible into a working height at the working part with the use of at least one reference value derived from the reference sensor.

12. Road processing machine according to claim 11, wherein the position element is positioned a distance away horizontally from the working part in the longitudinal direction of the road processing machine by the whole longitudinal extension, of the road processing machine.

13. Road processing machine according to claim 11, wherein the position element is arranged at the extreme left or extreme right front end, in the travel direction, and the working part is arranged at the rear end of the road processing machine in the travel direction.

14. Road processing machine according to claim 11, wherein the working part is in the form of a screeding beam.

15. Road processing machine according to claim 11, wherein at least one reference sensor is in the form of a tilt sensor which is to be arranged on a fixed link between the position element and the working part and makes it possible to derive a height difference between the positional height of the position element and the working height of the working part.

16. Road processing machine according to claim 11, wherein at least two reference sensors are in the form of first and second distance sensor, the first distance sensor being arranged at the position element and the second at the working part so that distance measurements to the base surface are made on the basis of the travel velocity at different times so that the two measurements are effected substantially at the same reference point.

17. System for carrying out a method for monitoring the travel path of a road processing machine driving on a base surface and the working height of a working part arranged thereon in a vertically adjustable manner, comprising:

a road processing machine according to claim 11, a station for determining the three-dimensional position of the position element and an evaluation and control device for evaluating the position information of the position element and for providing control information for controlling the road processing machine and the height adjustment of the working part.

18. System according to claim 17, wherein the evaluation and control device is arranged on the road processing machine.

19. Method for monitoring the travel path of a road processing machine according to claim 1, in which method the three-dimensional position of a position element arranged on the road processing machine is determined, a travel direction is determined from at least two three-dimensional positions at two times or from two position coordinates, and the working height of the working part is determined.

20. Method according to claim 8, wherein the position of the reference point is derived from the positional height of the position element and the at least one first distance measurement and, while the road processing machine is traveling where a base height of the base surface is determined at least along a line.

* * * * *